US006726051B1

(12) United States Patent
Rennick

(10) Patent No.: US 6,726,051 B1
(45) Date of Patent: Apr. 27, 2004

(54) OUTDOOR CIGAR AND CIGARETTE BUTTS RECEPTACLE

(76) Inventor: Robert D. Rennick, 2 Overlook Dr., St. Clair, PA (US) 17901

( * ) Notice: Subject to any disclaimer, the term of this patent is extended or adjusted under 35 U.S.C. 154(b) by 15 days.

(21) Appl. No.: 10/303,932

(22) Filed: Nov. 26, 2002

Related U.S. Application Data

(60) Provisional application No. 60/343,216, filed on Dec. 31, 2001.

(51) Int. Cl.[7] ..... A24F 19/00; A24F 21/00

(52) U.S. Cl. ..... 220/576; 131/242; 131/8; 220/820

(58) Field of Search ..... 220/576, 911, 220/820; 131/242, 241, 240.1

(56) References Cited

U.S. PATENT DOCUMENTS 1,695,346 A * 12/1928 Reese ..... 131/231
1,767,476 A * 6/1930 Putterman ..... 131/231
2,765,794 A * 10/1956 Sheppard ..... 131/235.1
4,187,864 A * 2/1980 Taddeo ..... 131/242
4,907,603 A * 3/1990 Chambers ..... 131/175
5,361,785 A * 11/1994 Wu ..... 131/235.1
6,135,305 A * 10/2000 Brady ..... 220/481

* cited by examiner

*Primary Examiner*—Joseph Man-Fu Moy
(74) *Attorney, Agent, or Firm*—A. R. Eglington

(57) ABSTRACT

A portable repository for discarded smoking products and incidental trash consisting of a hollow body having a closed upper surface and a pivotable bottom member providing a variable degree of closure for the lower surface, the bottom member normally providing a recessed cavity. An aperture is provided near the upper end to access the cavity for trash deposit having an appended ledge for butt snuffing and perforations in the sidewall for tying the repository to a support post.

10 Claims, 5 Drawing Sheets

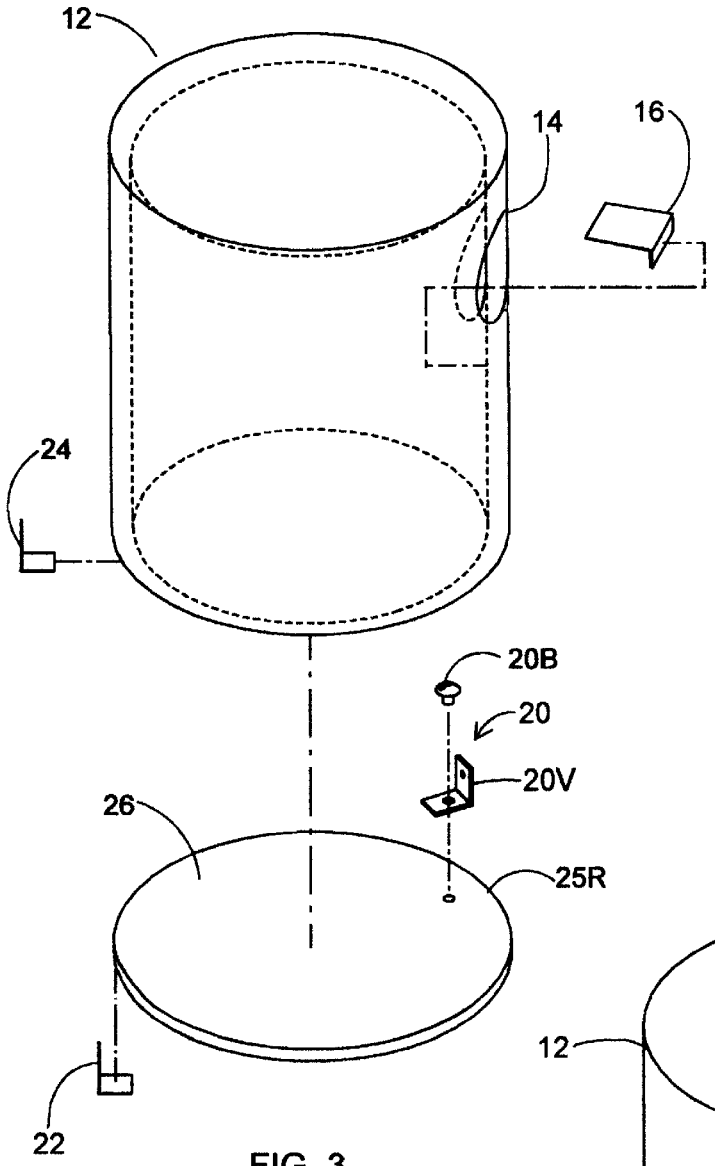
FIG. 3
FIG. 4
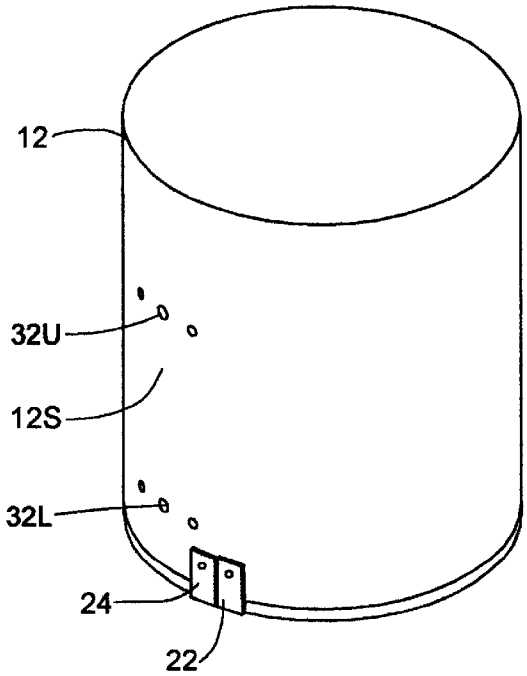

OUTDOOR CIGAR AND CIGARETTE BUTTS RECEPTACLE

This is a regular patent specification and claims submitted for an official filing receipt under Code Section 111 (a/b). It is a continuation-in-part of my co-pending provisional Specification filed Dec. 31, 2001, assigned U.S. Ser. No. 60/343,216.

BACKGROUND OF THE INVENTION

This invention relates generally to receptacles for cigar and cigarette butts, and more particularly to a cigarette butt receptacle adapted to be set alongside of public areas, especially at golf course tees, wherein scattered butts cause a nuisance.

Heretofore, various types of receptacles for cigar and cigarette butts have been proposed. For instance, in public halls or out of doors, where a great many people gather, often smoking stands, and of various designs are placed in the area, where smoking is allowed.

However, such smoking points, and the like, used at, for instance, golf courses, are in most cases, too complicated of construction, so that they are unsuitable to be set up along outside sports areas where the expected amount of cigar and cigarette butts are not as great.

It is consequently desirous to provide an effective means for extinguishing a lit cigar or cigarette, that is both safe, easy to manufacture, and simple to clean.

Accordingly, it is a principal object of the invention to provide an outdoor receptacle for the disposal of cigar and cigarette butts, that is compact, convenient to use, and easy to dump contents by transient service personnel.

A further object of the invention is to provide such a means that is easy to clean and maintain.

It is also an object to provide such means that is not limited in installation sites and can therefore enjoy widespread use at sports event rest stops.

It is another object of the invention to provide such a means that is technically uncomplicated, aesthetically pleasing and inexpensive to manufacture.

SUMMARY OF THE INVENTION

With all of the above-described objects and required features in mind, a tobacco products butt receptacle, in accordance with the present invention comprises: a readily mountable, portable receptacle adapted for outdoor positioning and for handy removal of its stored contents, comprising: (a) a main body consisting essentially of a hollow rigid body with a closed upper end conveniently fabricated in the form of a hollow cylinder or sleeve; (b) an imperforate planar bottom closure member adapted to be rotated between the closed position spanning the body lower end, and an open position for the dumping of receptacle contents, as required; (c) a single port located in the cylinder sidewall proximal the upper end; (d) an arcuate ledge positioned within the main body adjacent and below the post, and proximal to the upper end of, and adapted to be secured about the inner sidewall thereof, in a substantially horizontal orientation; and, (e) at least one pair of vertically oriented perforations in the main body sidewall serving to provide points of attachment via a flexible cord, the latter sidewall perforations being adapted to tie the receptacle to any support post. Optionally, a bracketing means can be re-secured to the main body sidewall and be employed to mount the device upon a support pole.

BRIEF DESCRIPTION OF THE DRAWINGS

FIG. 3 is an exploded perspective view of the butt receptacle components.

FIG. 4 is another perspective view of the receptacle of FIG. 1 rotated to display perforations.

DETAILED DESCRIPTION OF PREFERRED EMBODIMENT

Figure 1:
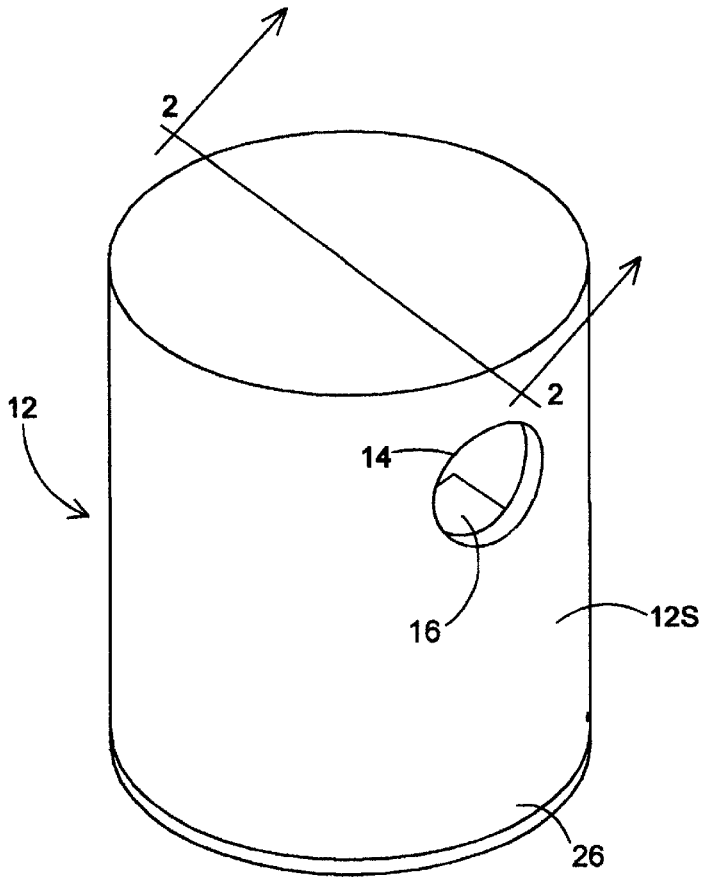
FIG. 1 is a perspective view of the assembled portable butt receptacle of the present invention.

Referring now to the drawing wherein like numerals indicate like elements, there is shown in FIG. 1, a perspective view of the butts receptacle, having a formed plastic, main body 12, conveniently configured in cylindrical form for economy of extrusion. A single enlarged port 14 is located in the upper half of the sidewall 12S. Mounted on the inner periphery of the sidewall, abutting and below the port 14 is a rigid ledge 16, formable from a segment of right angle iron.

Figure 2:
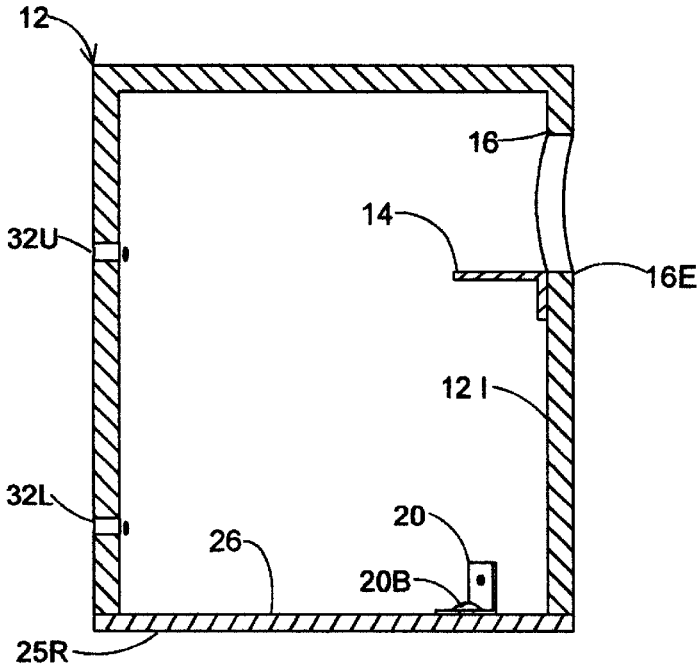
FIG. 2 is a vertical sectional view, of the main body of the receptacle, which is taken along listed II—II of FIG. 1.

In the vertical sectional view of FIG. 2 of the first embodiment, the form of the inner ledge and bottom closure means are better visualized. L-angle inner fixture 14 is depicted mounted adjacent to single point 16E, while the lower L-angle bracket 20, bridges the lower periphery of the sidewall 121 and is concurrently affixed to circular bottom plate 26.

In the isometric exploded view FIG. 3 of the receptacle, all the major parts are depicted: main body 12, port 14, ledge 16, bottom plate 26, internal hinging bracket 20 for bottom plate 26, and an external hinging bracket 22, which is more or less diametrically opposed to pivot point, bracket 20. The last is adapted for pivotally pinning, at one point, the bottom plate 26 to the lower edge 24 of main body 12. Also depicted in FIG. 3, is the vertical segment 20V of an L-bracket 20, which bracket is fastened to the lower peripheral edge 25R of body 12. The vertical segment 20V serves at a detent point for a single variably offset arrest tab 24, located on, and integral with, the periphery of bottom closure plate 26 (FIG. 4). Also, two paired sets of sidewall perforations, 32U and 34L, are provided in mid-sidewall. A conventional flexible tying element for receptacle mounting to support post is omitted in this view.

Figure 5:
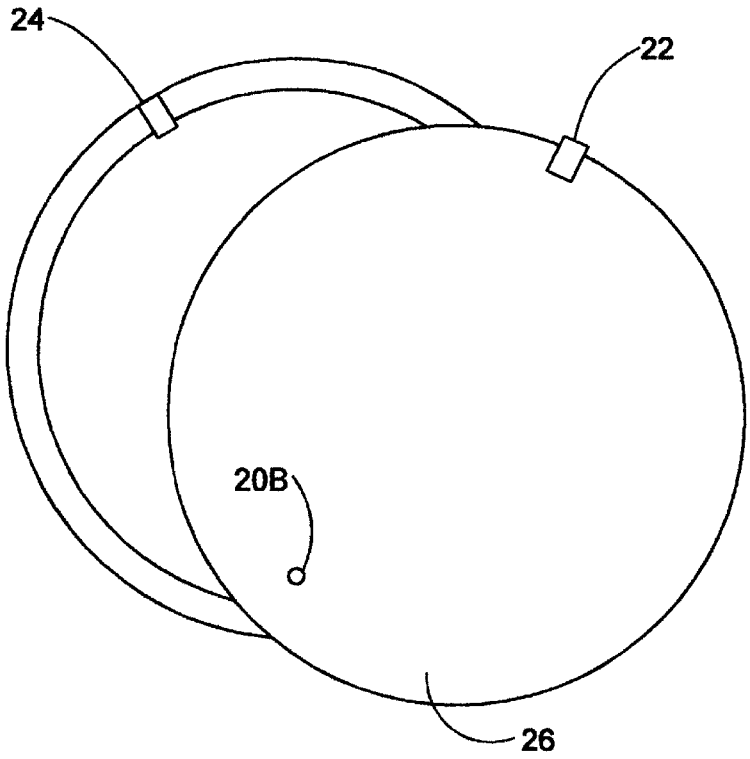
FIG. 5 is a bottom plan view of the mounted receptacle, with the hinged bottom plate having been manually displaced to open position to dump the contents, also depicting the catch means of holding.

In the bottom plan view of FIG. 5, the bottom plate 26 has been partly swung out, such as when it is desired to dump the accumulated trashed debris (not seen). The opposing arrest bracket 24 is seen, while the plate-support, hinged bracket 20 is concealed. Upon rotating plate 26 counterclockwise, it will arrest against bracket leg 22, providing a fully closed position bottom member 26. A set of vertically-aligned sets of perforations, 32U/32L, are seen on the receptacle sidewall; such perforations serve to fasten same to a vertical post (not shown).

Figure 6:
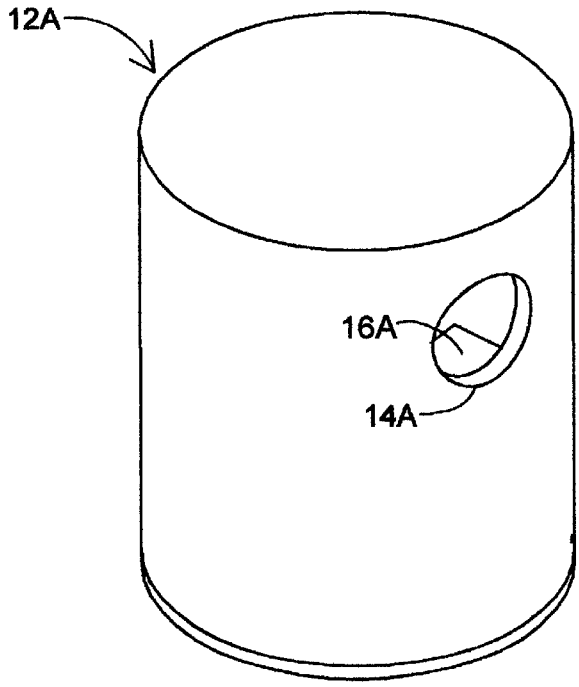
FIG. 6 is a perspective view of an alternate embodiment of reduced dimensions and adapted for other uses.

An alternate embodiment of the receptacle device of the present invention is shown in FIG. 6. The major difference is in reduced overall dimensions, which facilitate other uses as in securing to the golf car roof supports. The common components are main body 12A, port 14A, ledge 16A and bottom plate 26A. These sets of perforations (FIG. 4) provide dual anchor points for tying the device to a support pole (not seen), and maintaining same in a vertical position. All the other concealed components of the second embodiment of FIG. 6 are essentially identical to those depicted in connection with FIGS. 2 and 3, except for reduced sizing adjustments.

As to materials of fabrication, as an alternate to use of PVC, Schedule 40 unthreaded pipe, the main body is to be fabricated from aluminum stock, which can be formed into the depicted physical form. The fastener on brackets 20/24, are ¼ and ⅜ inches in length, being received in tapped ports in the bottom plate and adjacent sidewall. As to the mounting of the device upon fixed position vertical post, ordinary metal or plastic flexible ties arc suitable, though a hard-wired option is also employable.

Figure 7:
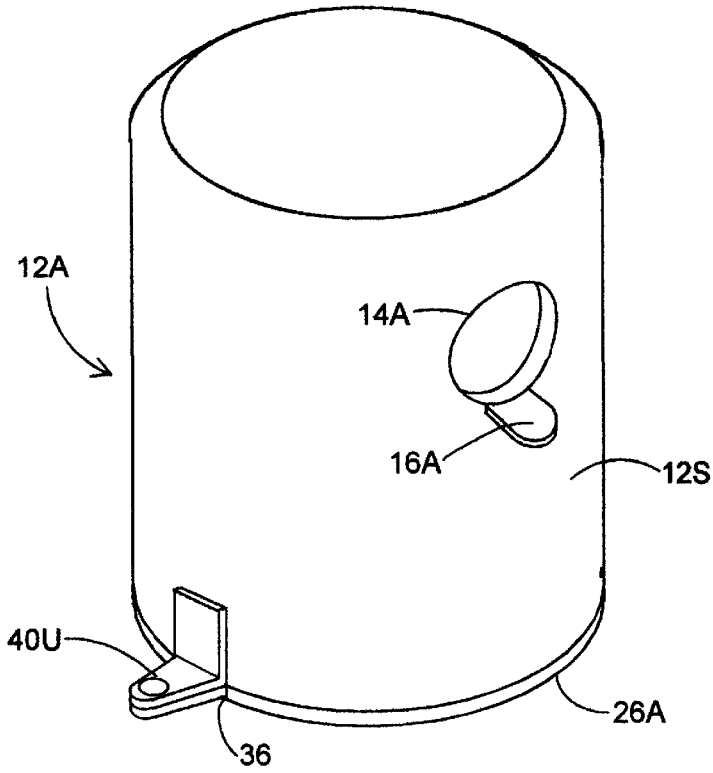
FIG. 7 is a perspective view of another and preferred embodiment of the portable butts receptacle of the present invention.
Figure 9:
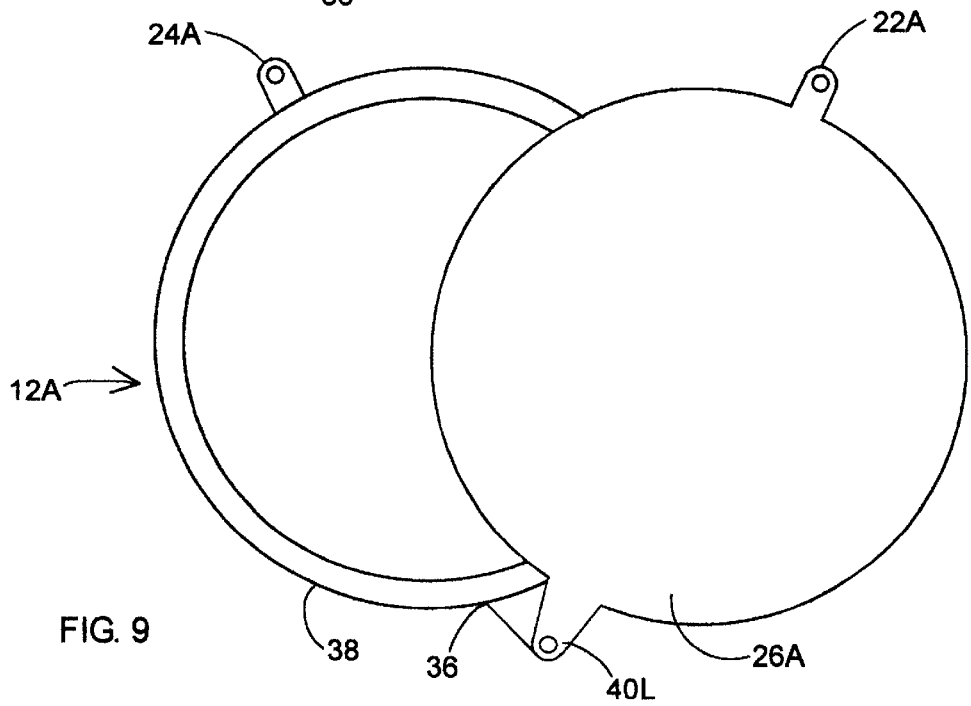

The now preferred embodiment of FIG. 7 is similarly configured to that of FIG. 1, and it preferably can be fabricated from a metallic material, such as aluminum stock, which is formed (by spinning) into the needed configuration. The surface is powder coated and then fired to provide a smooth, esthetically appealing and imprintable external surface.

The receptacle of FIG. 7 has a rigid main body 12A, an enlarged aperture 14A, a formed, externally projecting ledge 16A, and a generally planar, closure member 26A. Member 26A is likewise hingedly connected at a lower point 36 to the circular periphery 38 of main body 12A. Also seen are an opposing pair of ears, 22A/24A, which provide the position arrest means for the underlying member 26A, when it is rotated to the closed bottom position of receptacle 12A, as depicted in FIG. 7.

Figure 8:
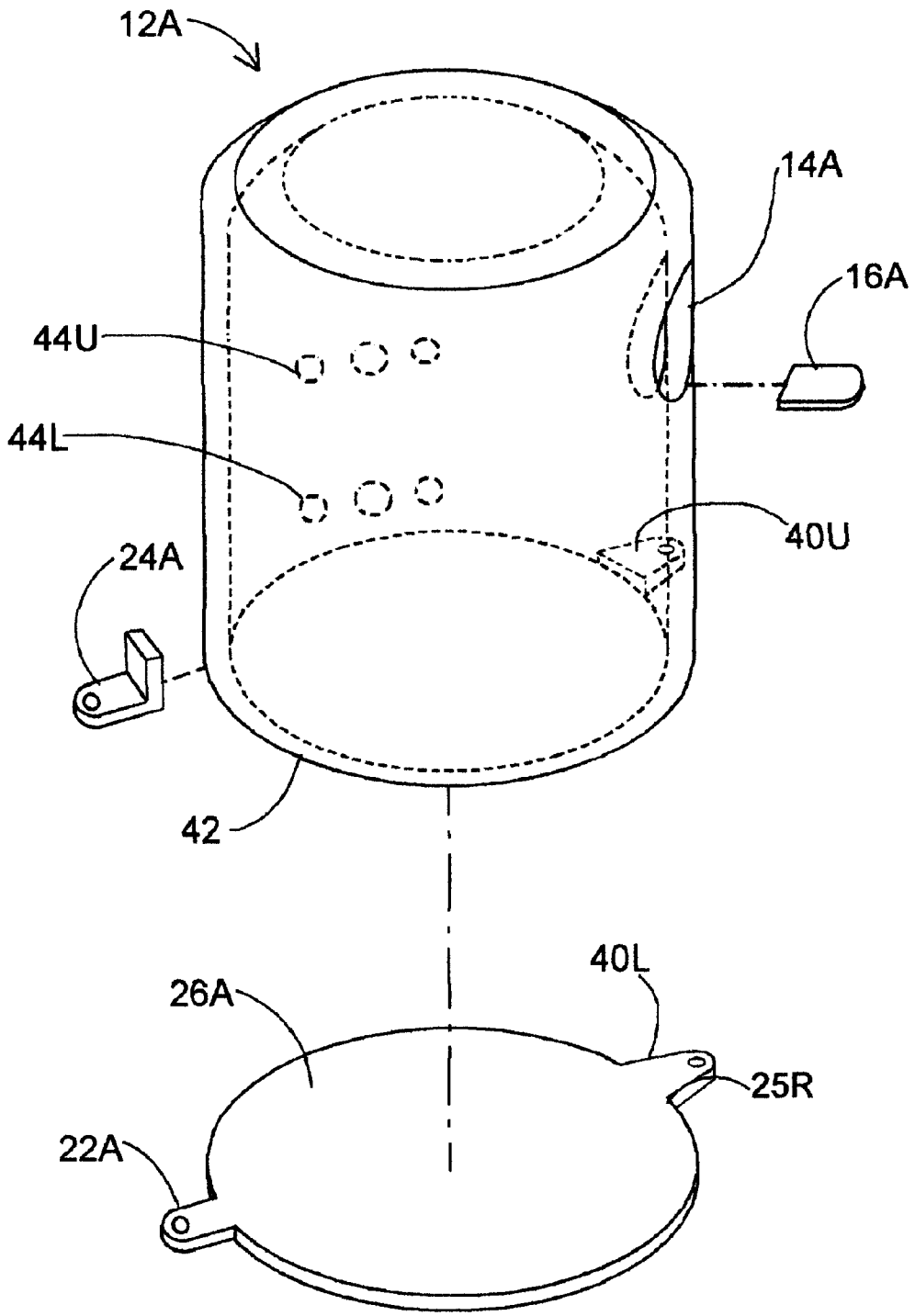
FIG. 8 is an exploded perspective view of the butts receptacle embodiment of FIG. 7 above; and, FIG. 9 is a bottom plan view of a post-mountable receptacle, having a hinged bottom member manually displaced from the closed position as depicted in FIG. 5, so as to facilitate dump of the receptacle contents, and also depicting the detente members for arresting the bottom member in the fully closed position.

In the isometric exploded view of FIG. 8, the receptacle of FIG. 7 with all of the major components are again seen: hollow body 12A, port 14A, ledge 16A, bottom closure member 26A, complemental external brackets, 22A/24A, and the now external hinging bracket 40L for the member 26A. Bracket 40A is adapted for pivotally pinning the bottom member 26A to the open circular periphery 42 of main body 12A. This hinging means thus serves as the anchor point for rotation of member 26A from a first closed position, as depicted in FIG. 7, to the partly open position depicted in FIG. 8.

As taught with the first embodiment, a conventional flexible tying element (not seen) is useful to retain the external brackets, 22A/24A, in their set position of receptacle 12A closure, and also such tying elements are useful with the paired sets of sidewall perforations, 44U/L of FIG. 8. The latter set serve to link the receptacle 12A to a vertical post (not seen) on a mounting station, such as one rod support member of a covered golf cart.

I claim:

1. A portable repository for discarded smoking products, comprising:

(a) a hollow body having a closed upper surface and adapted to permit a variable degree of closure for the open lower surface, thereby defining a recessed cavity having upstanding sidewalls conjoined with the closed upper surface;

(b) an aperture located proximal to the upper surface of the rigid body of sufficient dimensions to allow a smoking product to be deposited within the cavity;

(c) a formed ledge, being generally horizontal in orientation, mounted upon the outer sidewall of the hollow body and positioned adjacent to the lower periphery of the aperture;

(d) a planar member sized to conform generally to the periphery of the lower surface of the hollow body and adapted to provide for selective intermittent closure of the cavity and for the containment of any deposited smoking products when the member rotated into a closed first position;

(e) a fastener means functionally and pivotally connecting said planar member to the lower periphery of the hollow body and adapted to permit manual rotation of the planar member from the closed first position to an open second position, in which latter such second position permits evacuation of the accumulated hollow body contents;

(f) a detent means adapted to arrest the planar member into the closed first position when it is manually rotated to such first position, so as to provide a receptacle for discarded smoking products; and, (g) a means to mount said repository to a support post adapted to present the repository to prospective users.

2. The repository of claim 1 wherein the fastener means for planar member attachment is an inwardly mounted L-shaped projection rigidly attached to the body sidewall on one leg and attached to the upper surface of the planar member via the other leg.

3. The detent means of claim 1 comprising a pair of substantially similar, L-shaped brackets with one secured to the outer sidewalls hollow body and the other secured to the periphery of the planar member, each positioned on it respective support means so as to be oriented abutting one another while the planar member is in the said first position.

4. The detent means of claim 1 wherein the pair of L-shaped brackets are located substanially diametrically opposite to the location of the fastener member.

5. The receptacle of claim 1 wherein the fastener means are an opposing pair of external projections which functionally interconnect the rigid body and the planar member as a first projection being integral with the periphery of the hollow body sidewalls, and the second projection being integral with a point proximal to the periphery of the planar member.

6. The means to mount of claim 1 comprising at least one set of perforations in the upstanding sidewalls to permit a flexible tying element to be threaded there-through and to service to mount the repository to a support post.

7. A portable repository for discarded smoking products, comprising:

(a) a hollow body having a closed upper surface and adapted to permit a variable degree of closure for the open lower surface, thereby defining a recessed cavity having upstanding sidewalls conjoined with the closed upper surface;

(b) an aperture located proximal to the upper surface of the rigid body of sufficient dimensions to allow a smoking product to be deposited within the cavity;

(c) a formed ledge, being generally horizontal in orientation mounted upon the outer sidewall of the hollow body and positioned adjacent to the lower periphery of the aperture;

(d) a planar member sized to conform generally to the periphery of the lower surface of the hollow body and adapted to provide for selective intermittent closure of the cavity and for the containment of any deposited smoking products when the member is rotated into a closed first position;

(e) a fastener means functionally and pivotally connecting said planar member to the lower periphery of the hollow body adapted to permit manual rotation of the planar member from the closed first position to an open second position, in which latter position such permits evacuation of the accumulated hollow body contents, and further comprising an opposing pair of external projections with interconnect the hollow body and the planar member;

(f) a detent means adapted to arrest the planar member into the closed first position when it is manually rotated to such first position, so as to provide a receptacle for discarded smoking products; and, (g) a means to mount said repository to a support post adapted to present the repository to prospective users.

8. The detent means of claim 7 comprising a pair of perforated ears, one ear being proximal the lower outer periphery of the hollow body, and the other ear being positioned on the rim of the planar member, so when aligned providing a common passage for receiving a displaceable locking pin, for holding said planar member in the first position.

9. The means to mount of claim 1 comprising at least one set of perforations in the upstanding sidewalls to permit a flexible tying element to be threaded there-through and to service to mount the repository to a support post.

10. The receptacle of claim 5 wherein the fastener means are an opposing pair of external projections which functionally interconnect the rigid body and the planar member as a first projection being integral with the periphery of the hollow body sidewalls, and the second projection being integral with a point proximal to the periphery of the planar member.

* * * * *